US007111552B2

(12) United States Patent
Kolbe et al.

(10) Patent No.: US 7,111,552 B2
(45) Date of Patent: Sep. 26, 2006

(54) PRINTING MACHINE

(75) Inventors: Wilfried Kolbe, Gülzow (DE); Bodo Steinmeier, Bielefeld (DE); Andreas Kückelmann, Ibbenbüren (DE)

(73) Assignee: Fisher & Krecke GmbH & Co., Bielefeld (DE)

( * ) Notice: Subject to any disclaimer, the term of this patent is extended or adjusted under 35 U.S.C. 154(b) by 0 days.

(21) Appl. No.: 10/858,918

(22) Filed: Jun. 2, 2004

(65) Prior Publication Data

US 2005/0000376 A1 Jan. 6, 2005

(30) Foreign Application Priority Data

Jul. 3, 2003 (EP) ..... 03015092

(51) Int. Cl.
*B41F 5/00* (2006.01)

(52) U.S. Cl. ..... 101/216; 101/212

(58) Field of Classification Search ..... 101/216
See application file for complete search history.

(56) References Cited

U.S. PATENT DOCUMENTS 6,202,316 B1 3/2001 Swift et al.
6,523,470 B1 2/2003 Kolbe et al.
6,701,838 B1 3/2004 Kolbe et al.
6,823,156 B1 * 11/2004 Okamoto ..... 399/119
2004/0095456 A1 * 5/2004 Yoshihara et al. ..... 347/152
2005/0016399 A1 * 1/2005 Holm et al. ..... 101/352.06

FOREIGN PATENT DOCUMENTS

| | | |
|---|---|---|
| DE | 880 143 | 10/1952 |
| EP | 0 150 047 | 7/1985 |
| EP | 0 225 995 | 6/1987 |

* cited by examiner

*Primary Examiner*—Daniel J. Colilla
*Assistant Examiner*—Marissa Ferguson-Samreth
(74) *Attorney, Agent, or Firm*—Richard M. Goldberg

(57) ABSTRACT

Printing machine with a machine frame (10) and at least two cylinders (16, 20) which cooperate during printing, and which are mounted in a framing (12, 14; 24) formed by the machine frame (10). The framing (12, 14; 24) includes a material which has, at least in a direction transverse to the axes of rotation on the cylinders (16, 20), a linear thermal expansion coefficient that is less than $2\times10^{-6}$ $K^{-1}$. The material can be a composite material, particularly a carbon fiber reinforced plastic.

15 Claims, 2 Drawing Sheets

PRINTING MACHINE

BACKGROUND OF THE INVENTION

The invention relates to a printing machine with a machine frame and at least two cylinders that cooperate during printing and that are mounted in a framing formed by the machine frame.

In printing machines, the cylinders which cooperate during printing usually are mounted at each of both ends of each cylinder in a side member of the machine frame. In a flexographic printing machine, for example, several printing units with printing cylinders are arranged around an impression cylinder. To achieve high quality printing results it is necessary that an optimal distance between the impression cylinder and the individual printing cylinders of the printing units is precisely adjusted. An expansion or a contraction of the impression cylinder caused by temperature variations would notably impair the printed image due to the large diameter of the impression cylinder, which can be in the range from 2 m to 3.5 m, for example. For this reason, the impression cylinder usually is temperature-regulated by a liquid coolant system, so that the overall size is kept with the required precision.

From the European patent specification EP 0 150 047 of the applicant the problem is known that, within a short period of time after starting the printing machine, intermittent printing occurs due to temperature variations of the machine frame in spite of a temperature stabilized impression cylinder. Given a linear thermal expansion coefficient of cast iron of approx. $9\times10^{-6}$ $K^{-1}$, a variation of the temperature of the machine frame by 10° C. results in a change of the distance between the printing cylinder and the impression cylinder by an amount of approximately 90 μm to 160 μm, depending on the diameter of the impression cylinder.

As a solution to this problem, the EP 0 150 047 suggests a temperature stabilized machine frame. For these purposes, the printing machine frame may, for instance, be provided with water channels for a temperature-regulating system. With a temperature-regulating device with a liquid coolant system, for example, the temperature variation of the machine frame can be limited to an amount of ±1° C. or ±0.5° C., given a variation of the ambient temperature in the print shop between 15° C. and 35° C., so that the required dimensional stability of the distance between the cylinders is ensured.

SUMMARY OF THE INVENTION

It is an object of the invention to provide a printing machine of the type described above, wherein the dimensional stability of the machine frame required for optimum printing quality is achieved in a simpler manner.

According to the invention, this problem is solved with a printing machine of the type described above in which the framing consists of a material which has at least in a direction transverse to the axes of rotation of the cylinders a linear thermal expansion coefficient that is less than $2\times10^{-6}$ $K^{-1}$. When the side members of the machine frame are mainly made of such material, the thermal expansion coefficients of the material in directions transverse to the axes of rotation of the cylinders determine the thermal expansion of the machine frame. Thereby, notedly larger temperature variations, for instance by 4° C., are permissible as compared to the utilization of a conventional cast iron machine frame, for example. As a result, the temperature-regulation of the machine frame is simplified.

An internal temperature-regulating system of the machine frame can be completely dispensed with, if the ambient temperature in the print shop is kept sufficiently constant. Depending on the application, a larger deviation of the distance may be acceptable at higher temperature variations. In these cases, a temperature-regulating system employing a liquid circulating through the machine frame may be dispensed with.

However, preferably a material is used the linear thermal expansion coefficient of which in said respective direction is even less than $1\times10^{-6}$ $K^{-1}$, more preferably less than $0.5\times10^{-6}$ $K^{-1}$. The smaller the thermal expansion coefficient is, the smaller is the need for temperature-regulating measures and the higher are the temperature variations in the print shop that may be tolerated while still ensuring a high print quality. By eliminating the liquid coolant device, the construction of the printing machine is simplified and, in addition, energy savings are achieved during operation.

When, in the following, a preferred range of less than $9\times10^{-6}$ $K^{-1}$ occasionally is specified for the linear thermal expansion coefficients, it also applies that a value less than $1\times10^{-6}$ $K^{-1}$ is more preferable and a value of less than $0.5\times10^{-6}$ $K^{-1}$ is especially preferred. In general, an expansion coefficient is the more advantageous, the closer it is to zero.

Preferred embodiments of the invention are indicated in the dependent claims.

In a particularly preferred embodiment, the framing has side members which comprise struts that form windows, said struts being of a material the linear thermal expansion coefficient of which is, for each strut, at least in the direction of the respective strut, less than $2\times10^{-6}$ $K^{-1}$. Therefore, it may be particularly advantageous to apply a material having a thermal expansion coefficient that is dependent on direction; for instance, the struts may be made of carbon fiber reinforced plastic the fibers of which are oriented in the lengthwise direction of each strut, respectively, and are surrounded by a plastic matrix. The linear thermal expansion coefficient in the direction of each strut may then be almost equal to zero.

In a strut that is constructed in the described manner, a thermal expansion coefficient in a direction transverse to the strut does contribute little to the thermal expansion of the machine frame. Therefore, the thermal expansion coefficient of the material in the respective directions of the struts determines the resulting thermal expansion of the machine frame along a imaginary line that connects two cylinders.

Preferably, the material of the frame is a composite material, in particular a fiber composite material. It is preferable that its strength is as high as possible. The composite material preferably is a material containing carbon fibers, more preferably carbon fiber reinforced plastic. Here, the carbon fibers may be oriented as described above. Composite materials of this type are disclosed, for example, in U.S. Pat. Nos. 6,523,470 and 6,701,838, the entire disclosures of which are incorporated herein by reference.

Preferably, the framing is made of a carbon fiber composite material containing carbon fiber mats.

In addition to the aforementioned materials, also concrete polymer or mineral casting may be used to produce the framing. This material may have the necessary mechanical properties if produced with a suitable process. Particularly, the material may have a thermal expansion coefficient, possibly dependent on the direction, that is less than that of steel. Utilizing this material has the same advantages as utilizing the materials described above. It shall be understood that other suitable, different composite materials, especially fiber composite materials, may be used to produce the framing.

BRIEF DESCRIPTION OF THE DRAWINGS

In the following, an embodiment of the invention will be further explained in conjunction with the drawing, in which.

DETAILED DESCRIPTION

Figure 1:
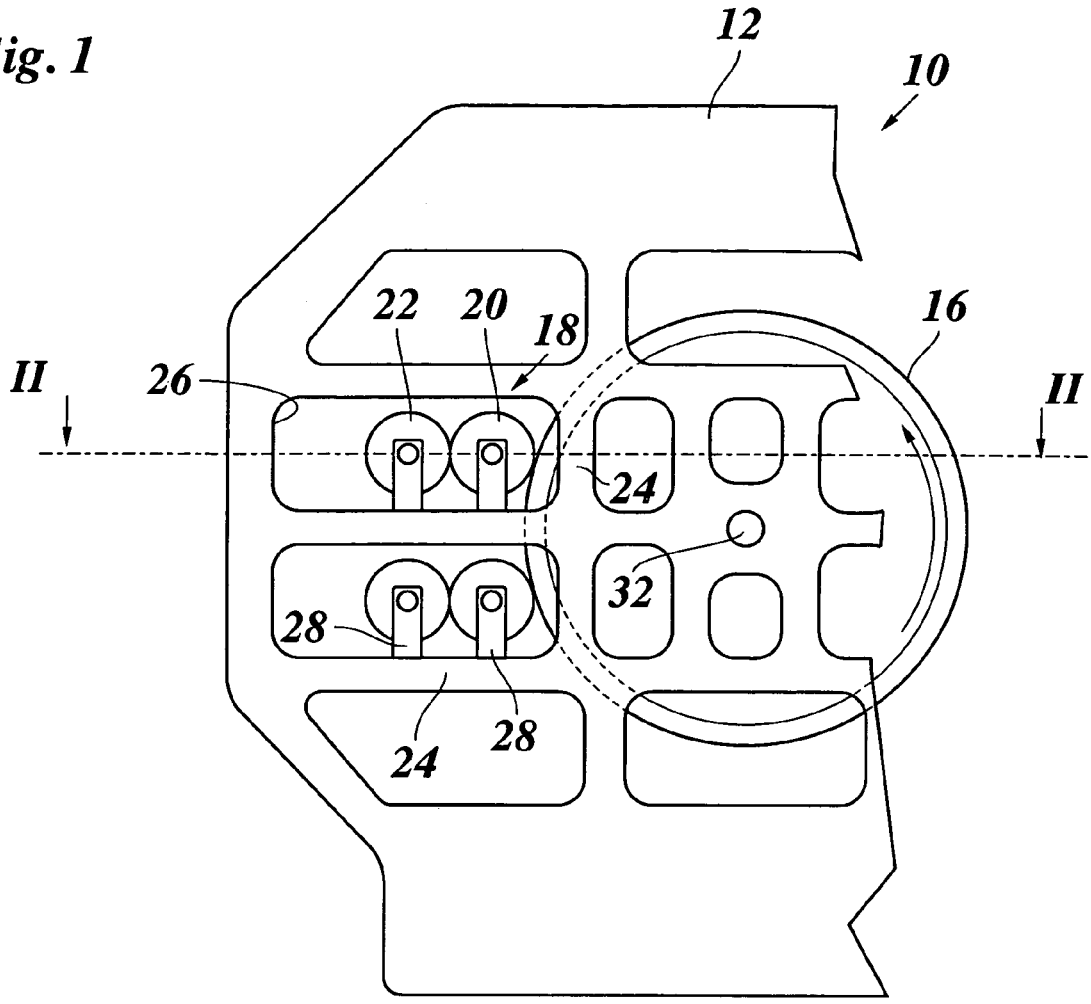
FIG. 1 is a partial side view of a printing machine.
Figure 2:
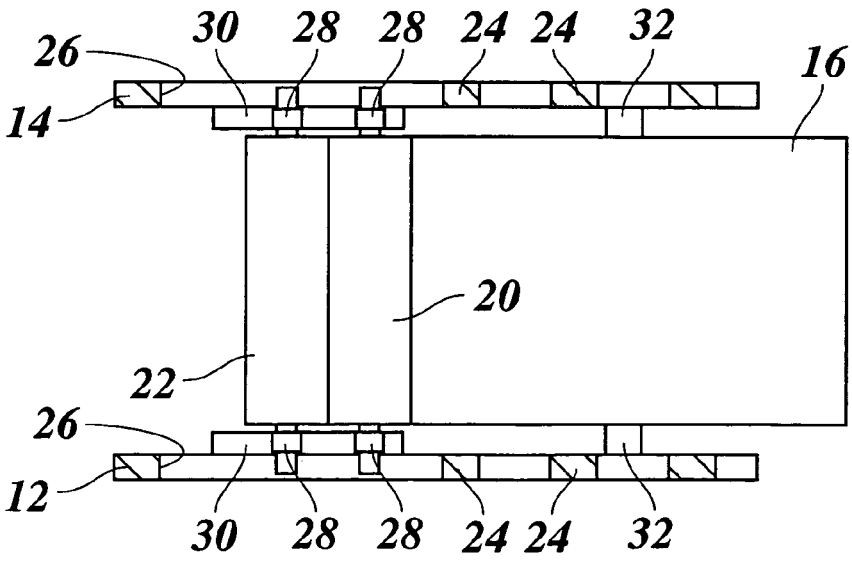
FIG. 2 is a sectional view along the line II—II in FIG. 1.

FIG. 1 shows a partial side view of a flexographic printing machine. FIG. 2 shows a sectional view along the line II—II of FIG. 1. The printing machine comprises a framing in the form of frame 10, which comprises two side members 12 and 14. In FIG. 1, only the side member 12 is visible. An impression cylinder 16 is mounted between the side members 12 and 14, and several inking units 18 are arranged around the periphery of the impression cylinder 16. Each inking unit 18 comprises a printing cylinder 20 and an inking roller 22. The side members 12 and 14 each comprise struts 24, inbetween which several windows 26 are formed. The printing cylinders 20 and the inking rollers 22 are mounted on slides 28 which are mobile along guiding rails 30. The guiding rails 30 each are mounted below a corresponding window 26 at the inner side of the side members 12 and 14, respectively. The impression cylinder 16 comprises axle journals 32 with which it is journalled in the side members 12 and 14.

The side members 12 and 14 of frame 10 each are made as a formed component of carbon fiber reinforced plastic (CFRP) by placing carbon fiber mats in layers into a mold and casting with plastic.

Advantages of using carbon fiber reinforced plastics are their low specific weight, their high strength and rigidity, their small thermal expansion coefficient, which is significantly smaller than $1\times10^{-6}$ $K^{-1}$ and is, depending on the direction, even approximately equal to zero, and, in addition, low manufacturing costs.

Figure 3:
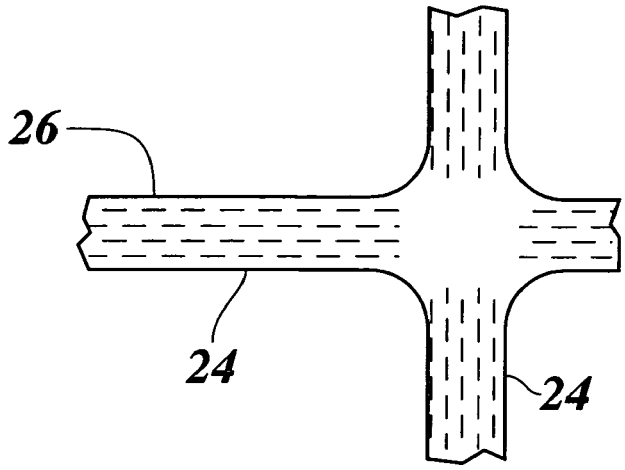
FIG. 3 shows struts of a machine frame.

FIG. 3 shows an enlarged view of struts 24 of the side member 12. Dashed lines indicate the orientations of the carbon fibers in the struts 24 in a respective direction of each respective strut 24, as achieved by suitable arrangement of the CFRP-layers.

Figure 4:
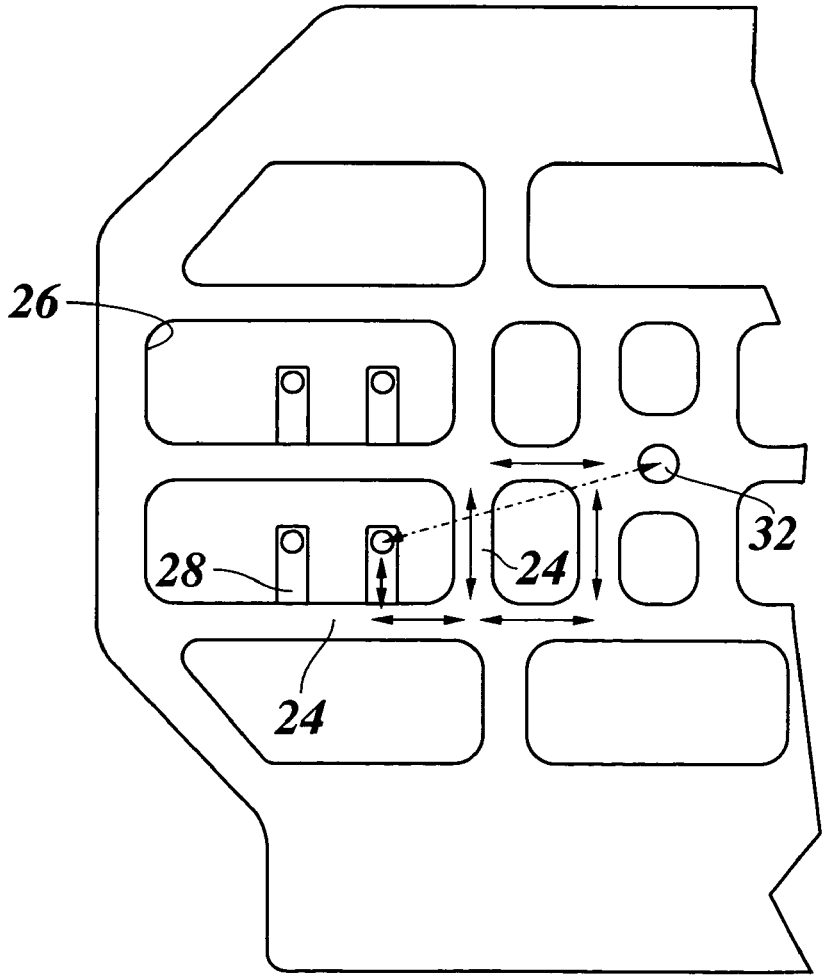
FIG. 4 is a partial view of FIG. 1.

FIG. 4 shows a partial view of the side member 12 of frame 10 of FIG. 1. Also shown are the slides 28. To exemplify, drawn through arrows on horizontal and vertical struts 24 indicate directions that correspond to orientations of the carbon fibers, the linear thermal expansion coefficient of the carbon fiber reinforced material being approximately zero along said directions. A chain dotted array indicates the connecting line between the journals of the impression cylinder 16 and a printing cylinder 20.

Due to the construction of the side member 12 having windows 26 and struts 24, along the indicated connection line an expansion coefficient results that substantially corresponds to the expansion coefficients in the directions indicated by drawn through arrows. Thereby, within the plane of side member 12, for each direction connecting two cylinders a resulting thermal expansion coefficient is achievable that is less than or equal to $0.45\times10^{-6}$ $K^{-1}$.

Thereby, given an assumed temperature variation of the ambient temperature in the print shop in the range from 15° C. to 35° C., a dimensional stability of the machine frame results which at least corresponds to that of a cast iron machine frame being temperature-regulated to ±0.5° C. and having a thermal expansion coefficient of $9\times10^{-6}$ $K^{-1}$. Therefore, a liquid temperature-regulating system can be dispensed with.

What is claimed is:

1. Rotary printing press, comprising:

a machine frame including framing and made of carbon fiber material;

at least two cylinders which cooperate during printing, and which are mounted in the framing;

the framing being comprised of a material which has, at least in a direction transverse to axes of rotation of the cylinders, a linear thermal expansion coefficient that is less than $2\times10^{-6}$ $K^{-1}$.

2. Rotary printing press according to claim 1, wherein the framing has side members which comprise struts that form windows, said struts being of a material having a linear thermal expansion coefficient which is, for each strut, at least in a lengthwise direction of the respective strut, less than $2\times10^{-6}$ $K^{-1}$.

3. Rotary printing press according to claim 2, wherein the material of the frame is a composite material.

4. Rotary printing press according to claim 3, wherein the composite material is a material including carbon fibers.

5. Rotary printing press according to claim 4, wherein the composite material is a carbon fiber reinforced plastic.

6. Rotary printing press according to claim 5, wherein the framing is made of a carbon fiber composite material including carbon fiber mats.

7. Rotary printing press according to claim 2, wherein the framing is made of a carbon fiber composite material including carbon fiber mats.

8. Rotary printing press according to claim 1, wherein there are two said side members which are parallel and spaced apart, with the cylinders supported by the two parallel, spaced apart side members.

9. Rotary printing press according to claim 1, wherein the framing consists essentially only of said material which has, at least in a direction transverse to axes of rotation of the cylinders, a linear thermal expansion coefficient that is less than $2\times10^{-6}$ $K^{-1}$.

10. Rotary printing press according to claim 1, wherein the material of the frame is a material other than metal.

11. Rotary printing press, comprising:

a machine frame including framing, the material of the frame being a composite material and wherein the composite material is a material including carbon fibers; and at least two cylinders which cooperate during printing, and which are mounted in the framing;

the framing being comprised of a material which has, at least in a direction transverse to axes of rotation of the cylinders, a linear thermal expansion coefficient that is less than $2\times10^{-6}$ $K^{-1}$.

12. Rotary printing press according to claim 11, wherein the composite material is a carbon fiber reinforced plastic.

13. Rotary printing press, according to claim 12, wherein the framing is made of a carbon fiber composite material including carbon fiber mats.

14. Rotary printing press according to claim 11, wherein the framing is made of carbon fiber composite material including carbon fiber mats.

15. Rotary printing press, comprising:

a machine frame including framing; and at least two cylinders which cooperate during printing, and which are mounted in the framing;

the framing being comprised of a material which has, at least in a direction transverse to axes of rotation of the cylinders, a linear thermal expansion coefficient that is less than $2\times10^{-6}$ $K^{-1}$, and wherein the framing is made of a carbon fiber composite material including carbon fiber mats.

* * * * *